US006278410B1

(12) United States Patent
Soliman et al.

(10) Patent No.: US 6,278,410 B1
(45) Date of Patent: Aug. 21, 2001

(54) WIDE FREQUENCY BAND PLANAR ANTENNA

(75) Inventors: Ezzeldin Soliman; Eric Beyne, both of Leuven; Walter De Raedt, Edegem; Guy Vandenbosch, Heindonk, all of (BE)

(73) Assignees: Interuniversitair Microelektronica Centrum, Leuven; Katholieke Universiteit Leuven Research & Development, Leuven, both of (BE)

( * ) Notice: Subject to any disclaimer, the term of this patent is extended or adjusted under 35 U.S.C. 154(b) by 0 days.

(21) Appl. No.: 09/450,214

(22) Filed: Nov. 29, 1999

(51) Int. Cl.[7] ..... H01Q 13/12

(52) U.S. Cl. ..... 343/769; 343/700 MS; 343/771

(58) Field of Search ..... 343/767, 769, 343/770, 700 MS, 768, 771, 829, 830, 846; H01Q 13/12, 13/10, 1/38

(56) References Cited

U.S. PATENT DOCUMENTS 4,509,209 * 4/1985 Itoh et al. ..... 343/700 MS
4,821,040 * 4/1989 Johnson et al. ..... 343/700 MS
5,714,961 * 2/1998 Kot et al. ..... 343/769
5,745,079 * 4/1998 Wang et al. ..... 343/700 MS

OTHER PUBLICATIONS

Soliman et al., (1998), "Suppression of the Parasitic Modes in CPW Discontinuities Using MCM–D Technology–Application to a Novel; 3–dB Power Splitter", *IEEE Transactions on Microwave Theory and Techniques*, vol. 46, No. 12, pp. 2426–2430.

Soliman et al., (1999), "CPW–FED CUSP Antenna", *Microwave and Optical Technology Letters*, vol. 22, No. 4, pp. 288–290.

* cited by examiner

*Primary Examiner*—Tho Phan
(74) *Attorney, Agent, or Firm*—McDonnell Boehnen Hulbert & Berghoff

(57) ABSTRACT

The present invention provides a planar antenna having a first, outer planar conductive element and a second planar conductive element located in a hole in the outer element. At least 75% of the boundary between the hole and the first outer planar conductive element is a continuous concave smooth curve. The second planar conductive element is substantially coplanar with and surrounded by the first outer planar conductive element. At least 75% of the outer boundary of the second planar conductive element is a continuously convex smooth curve.

18 Claims, 5 Drawing Sheets

WIDE FREQUENCY BAND PLANAR ANTENNA

FIELD OF THE INVENTION

The present invention relates to planar antennas, in particularly dual frequency or wide frequency band antennas, in particular slot antennas.

TECHNICAL BACKGROUND

Planar antennas are finding increasing popularity owing to their low profile, light weight, and possible conformity to supporting structures. The most serious limitation of these antennas is the narrow bandwidth of the single element. The traditional microstrip patch antenna has an impedance bandwidth of only few percent. Several methods have been used to widen the impedance bandwidth of the patch antenna. See, e.g., D. M. Pozar and D. H. Schaubert, editors, "A review of bandwidth enhancement techniques for microstrip antennas", Microstrip Antennas, the Analysis and Design of Microstrip Antennas and Arrays, IEEE press, pp. 157–166, 1995, which is hereby incorporated by reference in its entirety. Parasitic elements can be stacked together with the driven element in a multilayer configuration. See, e.g., F. Croq and D. M. Pozar, "Millimeter wave design of wideband slot coupled stacked microstrip antennas", IEEE Trans. Antennas Propagation, vol. 39, pp. 1770–1776, Dec. 1991, which is hereby incorporated by reference in its entirety. The difference in size of the two resonators results in a bandwidth of 10–20%. Several log-periodically scaled microstrip patches can be series-fed to achieve an impedance bandwidth of 22%. See, e.g., H. Pues, J. Bogaers, R. Pieck and A. Van de Capelle, "Wideband quasi-log-periodic microstrip antenna", IEE Proc. Vol. 128, Part H., pp. 159–163, June 1981, which is hereby incorporated by reference in its entirety.

SUMMARY OF THE INVENTION

The present invention may provide a planar antenna comprising: a first outer planar conductive element defining an inner hole, at least 75% of the boundary between the hole and the first outer planar conductive element being a continuously concave smooth curve; and a second planar conductive element substantially coplanar with the first outer planar conductive element, the second planar conductive element being located in the hole, at least 75% of the outer boundary of the second planar conductive element being a continuously convex smooth curve. The air or insulating space between the first and second planar conductive elements in the plane thereof forms the slot of a slot antenna. Preferably, the center of gravity of the hole of the first outer planar conductive element is offset from the center of gravity of the second planar conductive element. The smooth curve may be a circle, an ellipse, an oval, an egg-shape etc. The antenna is a slot antenna where the slot is defined by the space between the offset second and first conductive elements. The offset is preferably sufficiently great that the slot has a dimension perpendicular to the offset direction of a half the wavelength of a resonant frequency of interest. The conductive elements are preferably mounted on a substrate comprising a dielectric material. Preferably, the dielectric material is a low loss material at the resonant frequency or frequencies of the antenna. Glass or ceramic or corderite are suitable materials. The distance "h" between the inner diameter of the outer conductive element and the outer diameter of the substrate is preferably about 0.4 $\lambda_0$ where $\lambda_0$ is the free space wavelength at 9.66 GHz.

The antenna in accordance with the present invention may have a bandwidth of 34% without the need of stacking several layers or using parasitic elements. The antenna may be fed by a microstrip line or by a coplanar waveguide (CPW) in order to be compatible with the evolution of the microwave systems from microstrip towards coplanar technology. See for example, H-C Liu, T-S Horng and N. G. Alexopoulos, "Radiation of printed antennas with coplanar waveguide feed", IEEE Trans. Antennas Propagat., vol. 43, pp. 1143–114 8, Oct. 1995, which is hereby incorporated by reference in its entirety. CPW lines may be preferable over microstrip lines as they may provide low radiation loss, less dispersion, less mutual coupling, and good control of their characteristic impedance.

The antenna may be built using coplanar technology. It has dual frequency operation, the first and the second resonances may be, for instance, in X-and Ku- bands respectively. The proposed antenna has wide band behavior around both resonance frequencies. It has a dipole like radiation pattern, which makes it suitable for phased array applications.

In the present invention, the word antenna is used to describe an element for radiating electromagnetic radiation in particular in short or medium wave radio frequencies as well as microwave frequencies and gigahertz and terahertz frequencies.

The dependent claims form embodiments of the present invention.

The present invention, its advantages and embodiments will now be described with reference to the following drawings.

As shown in the figures, the solid line,_____, represents the simulation results, and the dashed line,_____, represents the measurements.

DESCRIPTION OF THE ILLUSTRATIVE EMBODIMENTS

The present invention will be described with reference to certain embodiments and to certain drawings but the present invention is not limited thereto but only by the claims.

Figure 1A:
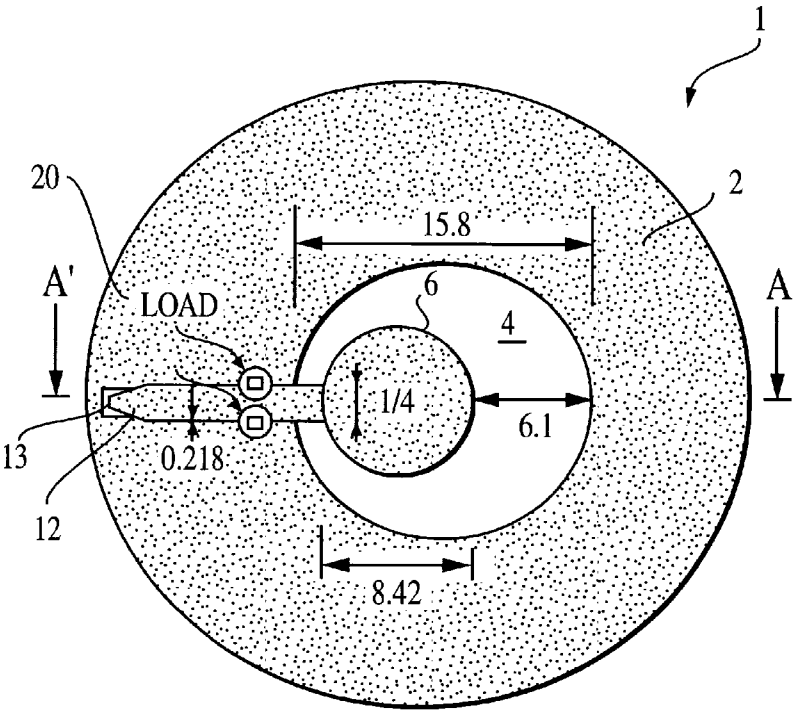
Fig. 1A is a schematic top view of an antenna in accordance with an embodiment of the present invention (dimensions in mm unless otherwise specified).
Figure 1B:
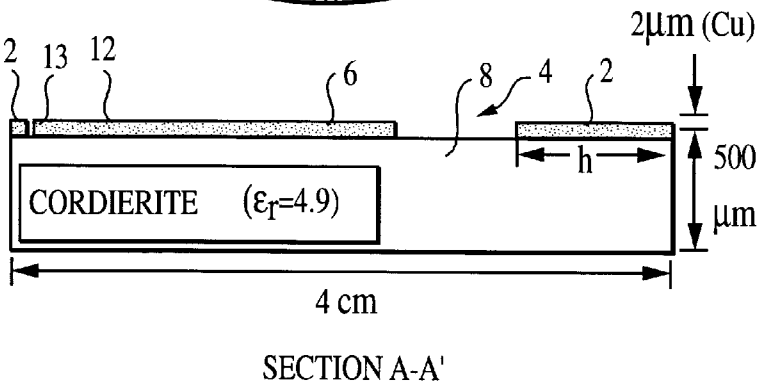
FIG. 1B is a section through the antenna of Fig. 1A.

FIGS. 1A and B show the geometry of a cusp antenna 1 in accordance with an embodiment of the present invention. FIG. 1A is a top view and FIG. 1B is a cross-sectional view of antenna 1. The antenna 1 includes an outer conductive element 2 which has an outer boundary shown as a circle but the present invention is not limited thereto. Within the outer conductive element 2, an opening or hole 4 is provided. A least 75% of the boundary between the outer conductive element 2 and the hole 4 is defined by a smooth, continuously concave curve. The curve may be part of a circle, an ellipse, an oval, an egg-shape or similar. Within the opening 4 a second inner conductive element 6 is located substantially coplanar with the outer element 2. About 75% of the outer boundary of the inner element 6 is defined by a smooth, continuously convex curve, e.g. a circle, an ellipse, an oval, an egg-shape or similar. The center of gravity of the inner element 6 is offset from the center of gravity of the hole 4 which forms a slot of a slot antenna. That means that if the inner boundary of the outer element 2 is a circle (the hole is a circle) and the outer boundary of the inner element 6 is a circle, then the center of the circle of the hole 4 is offset from the center of the circle of the inner element 6. The offset is preferably such as to form the slot at the side of the inner element 6 remote from an antenna feed 12. Copper thin film of 2 $\mu$ thickness may be used for the outer and inner conductive elements 2, 6. The antenna 1 may be mounted on a dielectric substrate 8 which may be co-extensive with the outer conductive element but this is not necessary in accordance with the present invention. The dielectric layer 8 may be made from a suitable dielectric, preferably with a low loss at the resonance frequency of the antenna 1, for instance, from cordierite with a dielectric constant of 4.9 and thickness of, for instance, 500 $\mu$m. Alternative suitable materials can be alumina, glass, quartz or a ceramic.

The antenna 1 is simple to manufacture owing to its single dielectric layer 8 and single metal layers 2, 6. The substrate 8 may be circular in shape, e.g. a wafer, with diameter of, for instance, 4 cm. The distance "h" between the inner diameter of the outer planar electrode 2 and the edge of the substrate is around 0.4 $\lambda_0$ where $\lambda_0$, is the free space wavelength at 9.66 GHz. The antenna 1 may be fed using a CPW line 12. A microstrip line or other load may be connected to the CPW line. Measurements may be performed using an on-wafer probe like that used to feed microwave planar circuits. A high precision positioner may be used to align the on-wafer probe during the measurements. In order to accommodate the on-wafer probe pitch, of 1 mm, to the pitch of the CPW, a printed taper 13 may be used, as shown in FIG. 1. This taper 13 is de-embedded from the measurements using appropriate calibration standards in the TRL calibration technique or similar, e.g. LRM or SOLT. Measurements are preferably performed inside an anechoic box in order to avoid any interaction between the antenna under test and the surroundings.

Figure 2:
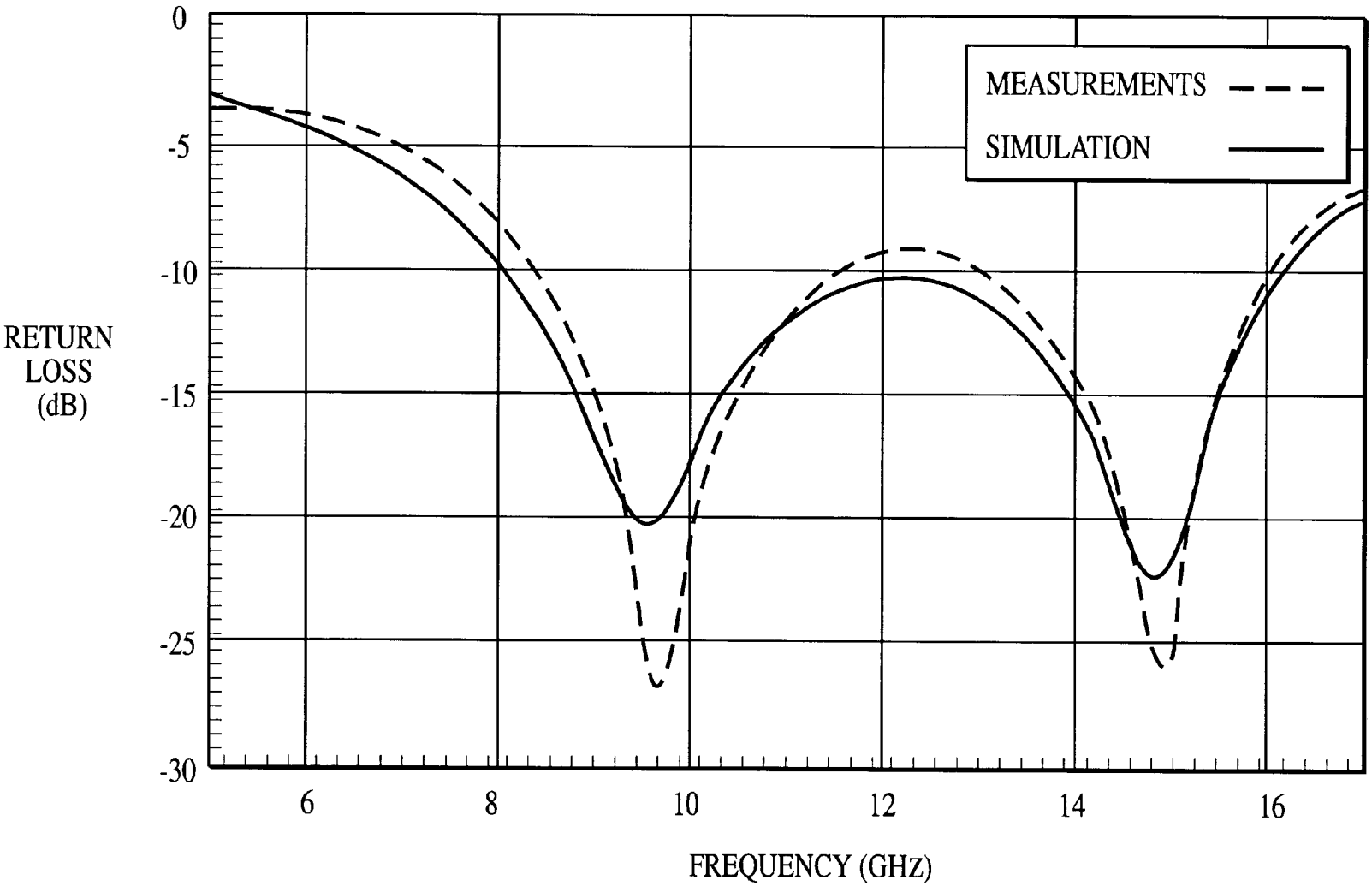
FIG. 2 is a comparison of measured and calculated return loss for the antenna of FIG. 1.

The measured and calculated return loss versus frequency characteristics of an antenna with the following dimensions are shown in FIG. 2. The maximum distance between the inner conductive element 6 and the outer element 2 was opposite the feed 12 and was 6.1 mm. The overall diameter of the outer element 2 and/or the substrate 8 was 4 cm. The hole at the center of the outer element 2 was circular with a diameter of 15.8 mm The inner element 6 was circular and had a diameter of 8.42 mm. The theoretical analysis is carried out using HP-Momentum supplied by Hewlett Packard, USA which is a planar electromagnetic simulator. Very good agreement between theory and measurements is observed. The antenna has two resonance frequencies around 9.657 GHz (X-band) and 14.83 GHz (Ku-band). The errors in the prediction of the first and the second resonance are−1.6%, and−0.1%, respectively. This small deviation between theory and measurements is partially due to the uncertainty of the thickness and/or the dielectric constant of the substrate 8. Moreover, the diffracted fields at the edge of the substrate, which are not considered in the simulation, may contribute to a small deviation between theory and measurements. The measured bandwidth, for an SWR (standing wave ratio) of less than 2, is 34% and 20% around the first and the second resonance frequencies, respectively. These figures of bandwidths are quite high for this class of planar antennas. The wide band behavior of the cusp antenna is a consequence of its geometry which is determined by the smooth curves of the inner and outer elements 2, 6, i.e. which do not show any sharp edges. Consequently, the geometry does not force strict resonance lengths on the antenna.

Figure 3:
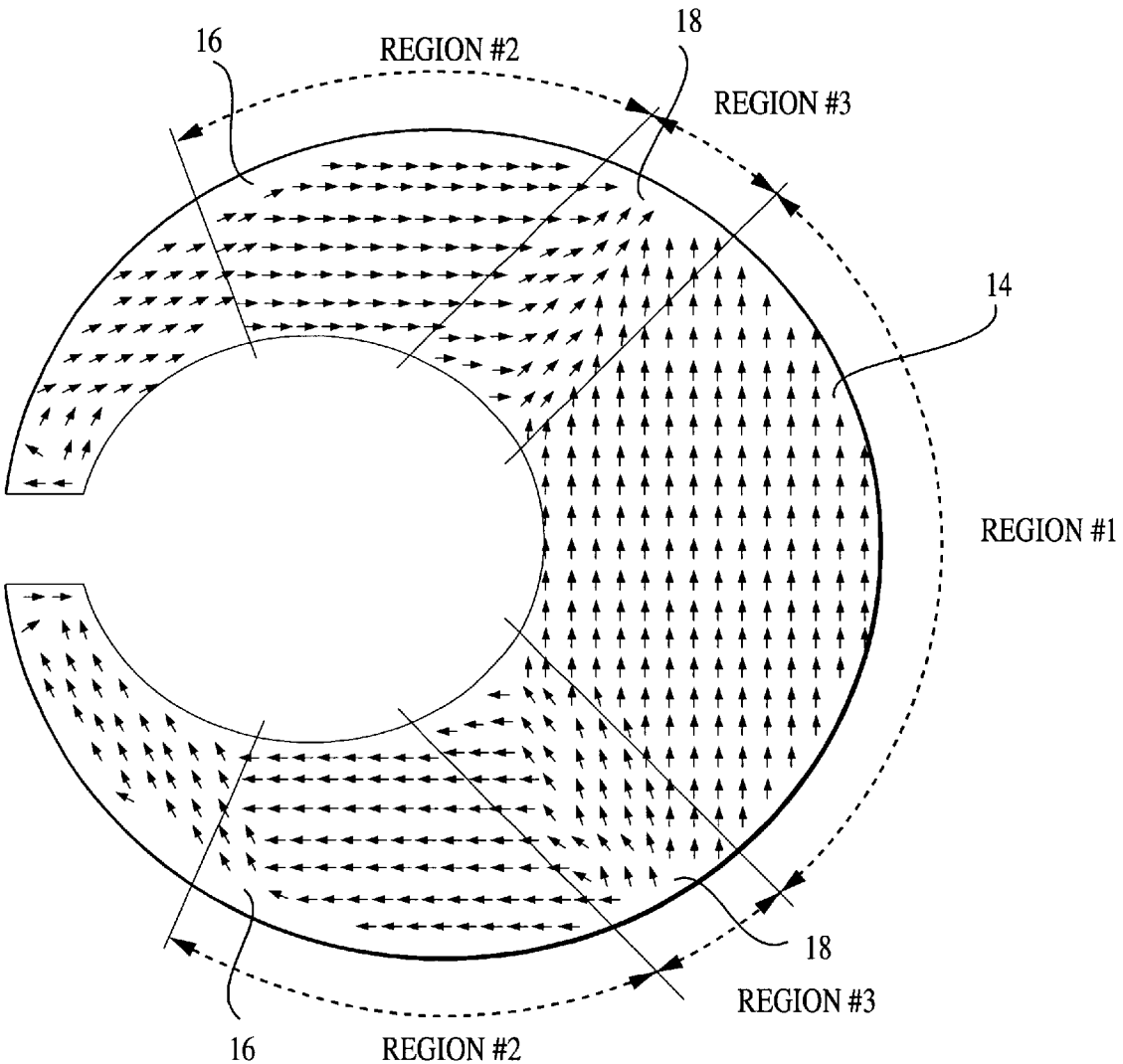
FIG. 3 is a non-limiting, schematic equivalent magnetic current distribution at a first resonance frequency of the antenna according to FIG. 1.
Figure 4:
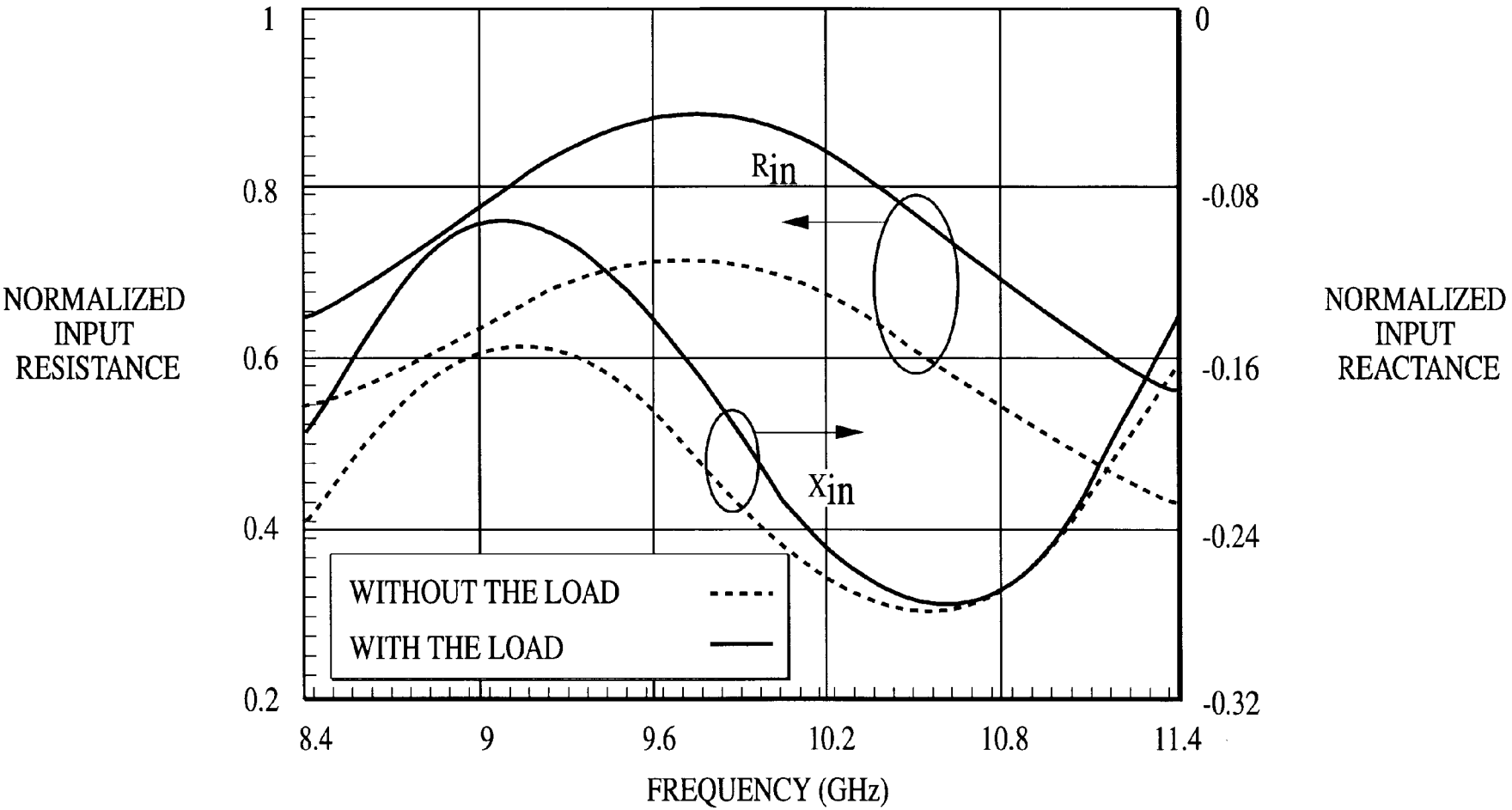
FIG. 4 is a graph showing normalized input impedance versus frequency for the antenna according to FIG. 1 with and without a load.

FIG. 3 shows a schematic equivalent magnetic current distribution, at the first resonance, as obtained from HP-Momentum simulations. This current distribution can be divided into three regions 14, 16, 18, as shown in FIG. 3. The first region 14 has vertical polarization of the magnetic current, this region is the main contributor to the radiation. The second region 16 which has a horizontal polarization of the current contributes to the cross polarization. The delimiter between the first and the second regions 14, 16 is defined as the third region 18, as shown in FIG. 3. The intensity of the current in the third region 18 is very small in comparison with the intensity in the second region 16 and extremely small if compared with the intensity of the first region 14. Consequently, the first region 14 shows standing wave behavior terminated by the two nulls of the third region 18. Monitoring the magnetic current distribution around the resonance frequency shows that the nulls, the third region 18, slightly rotate and try to keep the electric length of the first region 14 the same. This adaptation of the current distribution gives the cusp antenna its wide band behavior. In order to fine tune the input impedance of the cusp antenna at resonance, a series load 20 may be connected to the antenna, as shown in FIG. 1. This inductive load 20 compensates for the capacitive load of the antenna 1. FIG. 4 shows the normalized input impedance of the antenna 1 versus frequency, with and without the series load 20. The normalization is done with respect to the characteristic impedance of the CPW which is nearly 50 Ω. The connection of the series load 20 results in reducing the reflection loss of the antenna 1 by 7 dB at resonance.

Figure 5:
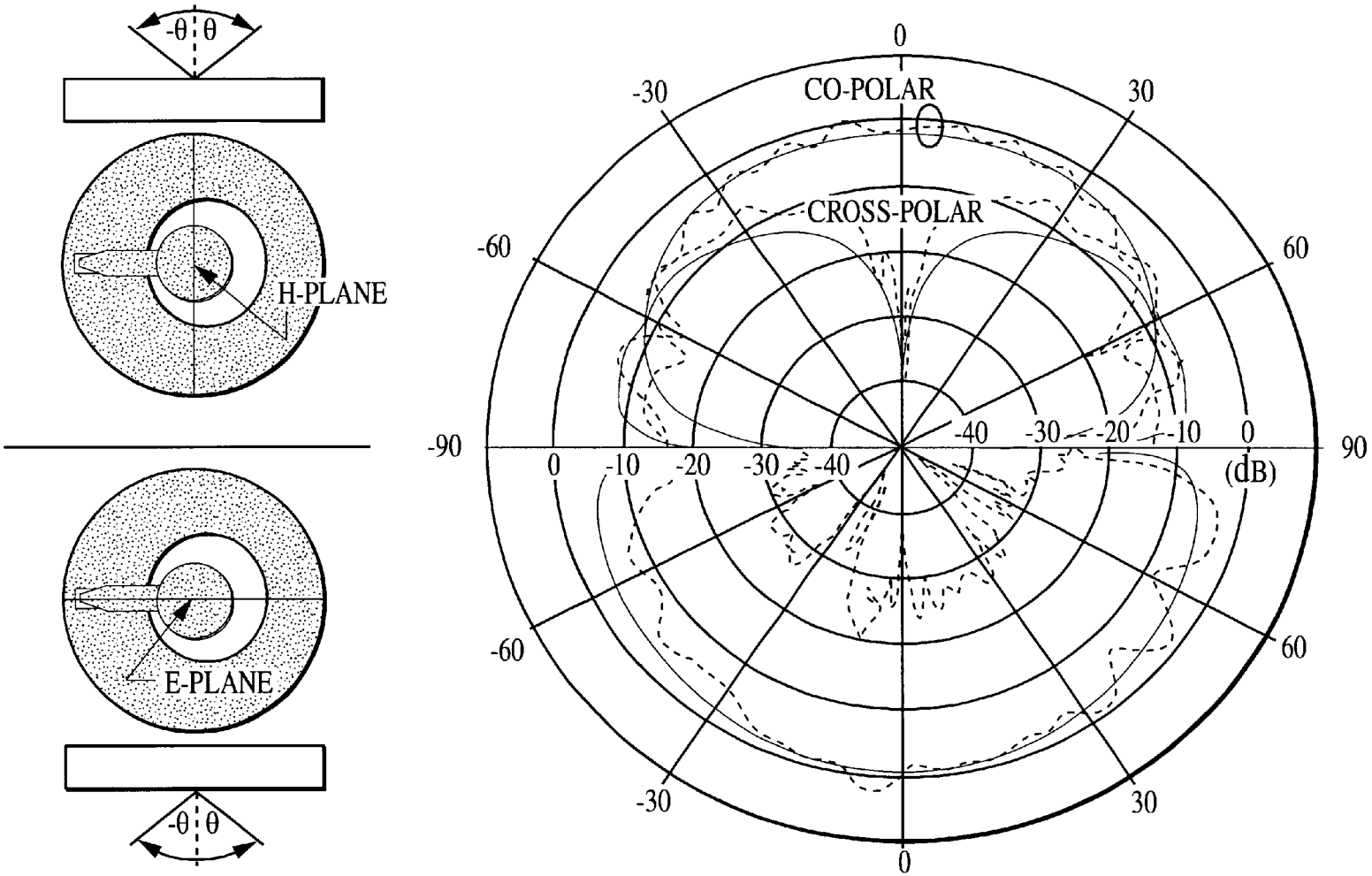
FIG. 5 shows radiation patterns at a resonance frequency of an antenna according FIG. 1, the upper half of the drawing represents the H-plane and the lower half represents the E-plane.

The measured and calculated radiation patterns of the cusp antenna at the first resonance, f=9.657 GHz, are shown in FIG. 5. The upper half represents the H-plane, the plane normal to the CPW, while the lower half represents the E-plane. The presented results in both planes correspond to the back-side, i.e. the half space below the substrate 8 in FIG. 1. It has been found from both measurements and simulation that the front-to-back ratio is 1:1 and the radiation patterns are almost identical in both sides. From the measurements point of view, the front-side suffers from blocking due to the existence of the positioning system in the line of sight between the transmitting antenna 1 and the receiving antenna under test. Consequently, the measurements are preferably taken from the back-side which does not suffer from any obstacles. FIG. 5 shows that the measured patterns suffer from a diffraction phenomenon. The diffraction pattern interferes with the far field pattern of the antenna 1, and as a result, the measured pattern oscillates around the calculated one. This significant diffraction was expected as the edge of the wafer 8 is only 0.4 $\lambda_0$ away from the antenna. The diffraction is more significant in the E-plane due to the fact that the space wave in the vicinity of the ground plane is stronger in the E-plane than in the H-plane. The measured cross polarization level in the E-plane is less than −25 dB. In the H-plane, the measured cross-polarization level around the normal direction to the plane of the antenna is less than −20dB. Due to the contribution of the horizontal components of the magnetic current, as in the second region 16 in FIG. 3, the cross-polarization level rises to −10 dB away from the normal direction to the antenna in the H-planes. These parasitic components of the magnetic currents cancel each other out along the normal direction to the antenna of the H-plane, and in the entire E-plane. The cusp antenna has a dipole like radiation patterns, which makes it suitable for the integration in a phased array. The measured gain of the cusp antenna is around 6 dB. This figure is reasonable for such class of planar antennas with bi-directional radiation patterns.

The antenna 1 described above has several advantages:

1) dual frequency operation, 2) wide impedance bandwidth, 3) ease in fabrication owing to its single metal and dielectric layer, and 4) ease of being fed with a CPW line 12 which is becoming a preferred feed for microwave antenna systems.

The antenna 1 has a dipole like radiation pattern which makes it very suitable for phased array applications. The antenna 1 may be realized or constructed on a small wafer of 4 cm diameter, for example. This results in a significant diffraction phenomenon which is more pronounced in the E-plane. To eliminate or minimize diffraction, it is preferred that a plurality of antennas in accordance with the present invention are formed into an array.

The slot antenna in accordance with the present invention may find advantageous use in applications requiring a bi-directional and nearly isotropic radiation pattern, such as for example a Blue Tooth communication system (information on Blue Tooth can be obtained from the internet address http://www.bluetooth.com). If backed by a ground plane (so that radiation in one direction is terminated by a conductive earthed plane), the slot antenna in accordance with the present invention provides a uni-directional radiative element which can be used in applications such as wireless Local Area Networks (wireless LAN) or can be placed at the focal point of a parabolic reflector or dish.

While the invention has been shown and described with reference to preferred embodiments, it will be understood by those skilled in the art that various changes or modifications in form and detail may be made without departing from the scope and spirit of this invention.

What is claimed is:

1. A planar antenna comprising:

a first outer planar conductive element defining an inner hole, at least 75% of the boundary between the hole and the first outer planar conductive element being a continuous concave smooth curve; and a second planar conductive element substantially coplanar with and surrounded by the first outer planar conductive element, the second planar conductive element being located in the hole, at least 75% of the outer boundary of the second planar conductive element being a continuously convex smooth curve, wherein a center of gravity of the hole of the first outer planar conductive element is offset from a center of gravity of the second planar conductive element to form a slot.

2. The antenna according to claim 1, wherein the smooth curve is a circle, an ellipse, an oval, or an egg-shape.

3. The antenna according to claim 1, wherein the slot is defined by the space between the offset second and first conductive elements.

4. The antenna according to claim 3, wherein the slot has a dimension perpendicular to the offset direction of at least 0.4 times the wavelength of a frequency at which the antenna is to operate.

5. The antenna according to claim 1, wherein the first and second conductive elements are mounted on a dielectric material.

6. The antenna according to claim 1, further comprising a conductive backing plate to eliminate radiation to and from the antenna in one direction.

7. The antenna according to claim 1, wherein a distance in the offset direction between an inner boundary of the first planar conductive element and an outer boundary thereof is 0.4 $\lambda_0$ where $\lambda_0$, is the free space wavelength at the operating frequency of the antenna.

8. The antenna according to claim 1, wherein the antenna has two resonance frequencies.

9. The antenna according to claim 8, wherein the resonance frequencies are in the GHz region.

10. A planar antenna comprising:

a first outer planar conductive element defining an inner hole, at least 75% of the boundary between the hole and the first outer planar conductive element being a continuous concave smooth curve; and a second planar conductive element substantially coplanar with and surrounded by the first outer planar conductive element, the second planar conductive element being located in the hole, at least 75% of the outer boundary of the second planar conductive element being a continuously convex smooth curve;

wherein the second conductive element is connected to a coplanar waveguide.

11. The antenna according to claim 10, wherein the smooth curve is a circle, an ellipse, an oval, or an egg-shape.

12. The antenna according to claim 10, wherein the first and second conductive elements are mounted on a dielectric material.

13. The antenna according to claim 10, further comprising a conductive backing plate to eliminate radiation to and from the antenna in one direction.

14. The antenna according to claim 10, wherein the antenna has two resonance frequencies.

15. The antenna according to claim 14, wherein the resonance frequencies are in the GHz region.

16. The antenna according to claim 10, wherein a center of gravity of the hole of the first outer planar conductive element is offset from a center of gravity of the second planar conductive element to form a slot.

17. The antenna according to claim 16, wherein the slot is defined by the space between the offset second and first conductive elements.

18. The antenna according to claim 16, wherein a distance in the offset direction between an inner boundary of the first planar conductive element and an outer boundary thereof is 0.4 $\lambda_0$, where $\lambda_0$ is the free space wavelength at the operating frequency of the antenna.

* * * * *